US005823151A

United States Patent [19]

Elendt et al.

[11] Patent Number: 5,823,151

[45] Date of Patent: Oct. 20, 1998

[54] VALVE GEAR CAM FOLLOWER IN AN INTERNAL COMBUSTION ENGINE

[75] Inventors: Harald Elendt, Wilhelmsdorf; Michael Haas, Weisendorf; Gerhard Maas, Herzogenaurach, all of Germany

[73] Assignee: Ina Walzlager Schaeffler KG, Germany

[21] Appl. No.: 930,529

[22] PCT Filed: Mar. 21, 1996

[86] PCT No.: PCT/EP96/01227

§ 371 Date: Oct. 20, 1997

§ 102(e) Date: Oct. 20, 1997

[87] PCT Pub. No.: WO96/34185

PCT Pub. Date: Oct. 31, 1996

[30] Foreign Application Priority Data

Apr. 26, 1995 [DE] Germany ..... 195 15 284.0

[51] Int. Cl.[6] ..... F01L 13/00; F01L 1/14; F01L 1/24

[52] U.S. Cl. ..... 123/90.16; 123/90.55

[58] Field of Search ..... 123/90.12, 90.15, 123/90.16, 90.48, 90.49, 90.55

[56] References Cited

U.S. PATENT DOCUMENTS

| | | | |
|---|---|---|---|
| 5,361,733 | 11/1994 | Spath et al. | 123/90.16 |
| 5,555,861 | 9/1996 | Mayr et al. | 123/90.16 |

FOREIGN PATENT DOCUMENTS

| | | |
|---|---|---|
| 563574 | 10/1993 | European Pat. Off. . |
| 4221134 | 7/1993 | Germany . |
| 4213856 | 10/1993 | Germany . |
| 4303789 | 8/1994 | Germany . |
| 4314619 | 11/1994 | Germany . |
| 4333927 | 4/1995 | Germany . |
| 91/12413 | 8/1991 | WIPO . |

OTHER PUBLICATIONS

Katogi Teiji, "Variable Valve Timing Device," vol. 16, No. 328, JP 4094405, Mar. 26, 1992 (abstract only).

Hirano Tomiyasu et al, "Valve System Having . . . Engine", JP 7317518, Dec. 5, 1995 (abstract only).

*Primary Examiner*—Weilun Lo

*Attorney, Agent, or Firm*—Bierman, Muserlian and Lucas

[57] ABSTRACT

In a switchable cam follower (1) comprising an inner element (2) and an outer element (3), with said inner element (2) comprising a hydraulic clearance compensation device (10), a coupling of the two elements (2, 3) is effected by radially extending coupling means (4). These coupling means (4) and the clearance compensation device (10) which is integrated in the inner element (2) are loaded by hydraulic pressure from a cylinder head of an internal combustion engine through separate channels (9, 8). According to the invention, the spring means (5) for the coupling means (4) are configured so that from a hydraulic medium pressure from about 0.6 bars on (idling engine speed), the elements (2, 3) are uncoupled. When a switching engine speed, for example, 3,000 rpm, has been reached, the hydraulic pressure in the channel (9) is reduced to about 0.1 bars by a control valve (11). The coupling means (4) are displaced by the spring means (5) into a coupling position. The two elements (2, 3) are connected physically to each other. At the same time, unchoked hydraulic pressure continues to prevail in the channel (8) so that even with increasing speed of the internal combustion engine, the clearance compensation device (10) is optimally supplied with hydraulic pressure.

5 Claims, 2 Drawing Sheets

3

VALVE GEAR CAM FOLLOWER IN AN INTERNAL COMBUSTION ENGINE

Figure 1:
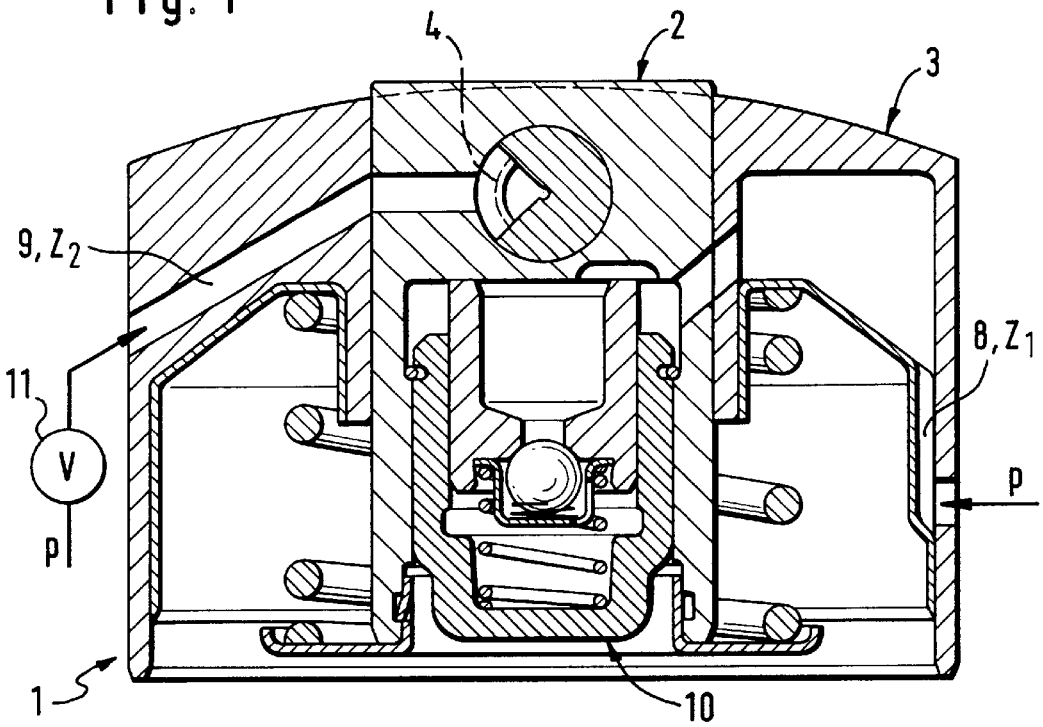

The invention concerns a cam follower of a valve drive of an internal combustion engine or a support element for a finger lever having means for switching to at least two different lifts of at least one gas exchange valve, comprising an inner element (2) and an outer element (3) which are inserted axially into each other and can be coupled to each other at least indirectly by coupling means (4) which are displaceable radially or secant-like, so that, in a coupled state of said inner and outer element (2, 3), a larger valve lift, and in an uncoupled state thereof, a smaller valve lift is realized, the coupling means (4) effecting coupling of said inner and outer element (2, 3) under the force of a spring means (5) and uncoupling under hydraulic pressure, said cam follower (1) further comprising two separate channels (9, $Z_2$; 8, $Z_1$) starting from the outer element (3) and extending in the inner element (2) to supply hydraulic medium pressure to the coupling means (4) and to a hydraulic clearance compensation device (10), a control valve (11) being arranged in front of the channel (9, $Z_2$) to the coupling means (4), which control valve (11), during warm running (operating temperature) of the internal combustion engine and during operation thereof in the partial and full load range, reduces the hydraulic pressure in the channel (9, $Z_2$) to a level which is lower than and distinct from the hydraulic pressure which serves to displace the coupling means (4) for uncoupling the elements (2, 3) so that a coupled state of the two elements (2, 3) prevails.

A species-defining cam follower of the pre-cited type is known from DE-G 93 15 436.4. In this cam follower, a coupling of the inner and the outer element is likewise effected by spring force and an uncoupling by hydraulic medium pressure. This principle of switching proves to be expedient for application to disconnectable cam followers and support elements because, for the initial starting as well as for renewed starting of the internal combustion engine, all the cylinders are required. Thus, it is only necessary that the two sections be coupled to each other during the starting operation which begins with an idling speed, so that the valve concerned opens following the high lift cam and a proper gas exchange can take place. On the other hand, after warming-up of the internal combustion engine, in a range between idling and partial load running, the two tappet sections should be uncoupled i.e., the coupling elements should be displaced by hydraulic medium pressure in uncoupling direction against the spring force. If a common supply of hydraulic medium is provided, and the two tappet sections are to be uncoupled, say at an engine speed of about 3000 rpm, hydraulic pressure must be reduced so that the coupling means are displaced into their uncoupling position. However, since at these speeds, the clearance compensation device has a relatively high hydraulic pressure requirement due to the increasing foaming of the hydraulic medium at higher speeds, it is necessary to switch from a relatively high hydraulic pressure level which holds the coupling means in an uncoupling position to a low hydraulic pressure. But this low hydraulic pressure must, at the same time, be sufficient to assure an optimal pressure supply to the clearance compensation element (e.g. 2 to 2.5 bars) at normally run engine speeds. As a result, the uncoupling pressure of the hydraulic medium would have to be situated above the aforementioned value. This would necessitate a hydraulic pump which produces very high hydraulic pressures already in the idling range and up to the lower partial load range. This cannot be realized with conventional pumps. On the other hand, the spring forces which load the coupling means against hydraulic pressure for establishing the desired coupled state would then also have to be extremely high. A limit to this is set already by the disposable design space itself in the cam follower.

From DE-GM 93 19 435.8, a support element having the features of the generic part of claim 1 is also known in the art. Similar to the cam follower described above, a coupling of the two components, housing and pressure piston, for obtaining a high cam lift is likewise effected by the force of a compression spring and an uncoupling, by hydraulic medium pressure. In the case of this prior art support element too, the spring force acting on the coupling means has to be configured relatively high because a coupling by the spring means is to be effected only at medium rpm's and therefore at relatively high supply pressures which are required for the clearance compensation element.

It is therefore an object of the invention to provide a cam follower of the pre-cited type in which the aforesaid drawbacks are eliminated and, particularly, a coupling and uncoupling device for its two elements is created with which the desired coupled and uncoupled states can be obtained with low hydraulic pressures and spring forces and, at the same time, an optimal supply of hydraulic pressure to the clearance compensation element is assured through the entire engine speed range.

Due to the fact that the supply of hydraulic pressure to the coupling means and to the clearance compensation device in the cam follower or the support element is effected through separate channels, and, at the same time, a control valve is arranged in front of the channel serving to supply pressure to the coupling means, it is possible for the first time to load the coupling means with extremely low switching pressures, while, at the same time, the clearance compensation device is optimally supplied with pressure over the entire engine running range. The design of the spring (relatively weak) assures that an uncoupling of the two sections can be effected at the idling speed and up to a partial load range of the internal combustion engine (for instance, 3,000 rpm).

The spring means which displace the coupling means in a coupling direction are designed so that the coupling means can be displaced in uncoupling direction at a hydraulic pressure of from 0.47 to about 0.6 bars. Thus, already at the idling speed of the internal combustion engine (for instance, 750 rpm) a reliable uncoupling of the two sections of the cam follower is assured, which was not dependably guaranteed hitherto with the high hydraulic pressures required in the prior art. At the same time, a control valve, needing no further specification here, reduces the hydraulic pressure in the channel to the coupling means to a level between 0 and approximately 0.3 bars starting from an engine speed of about 3.000 rpm up to the maximum running speed so that the coupling means can be displaced in coupling direction by the force of the low-dimension spring means. Simultaneously, the unhindered hydraulic pressure prevailing in the channel in front of the clearance compensation device assures that this is optimally supplied with hydraulic pressure over the entire engine speed range and thus, also, when foaming of the oil increases. According to a further important feature of the invention, the hysteresis range between reliable uncoupling and reliable coupling is designed to be sufficiently large to avoid unreliable states of switching. In other words, the tolerance zone of the control valve in the state in which it shuts off hydraulic pressure must be sufficiently separated from the tolerance zone of reliable uncoupling of the coupling means during warm idling (see also FIG. 3).

According to a further feature of the invention, in the coupled state of the elements, the control valve reduces the hydraulic pressure in the channel in front of the coupling means to about 0.1 bars. It is conceivable to reduce the hydraulic pressure in this channel for this state of coupling even to 0 bars, but a slight raising of this pressure to about 0.1 bars guarantees a more rapid response of the aforesaid device.

This reduction of hydraulic pressure is effected from an engine speed of the internal combustion engine of approx. 3.000 rpm on but other switching rpm's are also conceivable depending on the type of internal combustion engine and other parameters.

Finally, in a further development of the invention, the hydraulic pressure in the channel in front of the coupling means is likewise reduced to about 0.1 bars after the cold starting of the engine till its warming up, so that the two elements are in the coupled state. This coupled state is an indispensable requirement for enabling a starting of the internal combustion engine.

Although the switchable cam follower described here is intended particularly for use in valve drives with selective cylinder switching-off such as can be realized, for example, in V-type engines, it is also conceivable to use it for switching off individual valves, for example, intake valves in multi-valve constructions.

Figure 2:
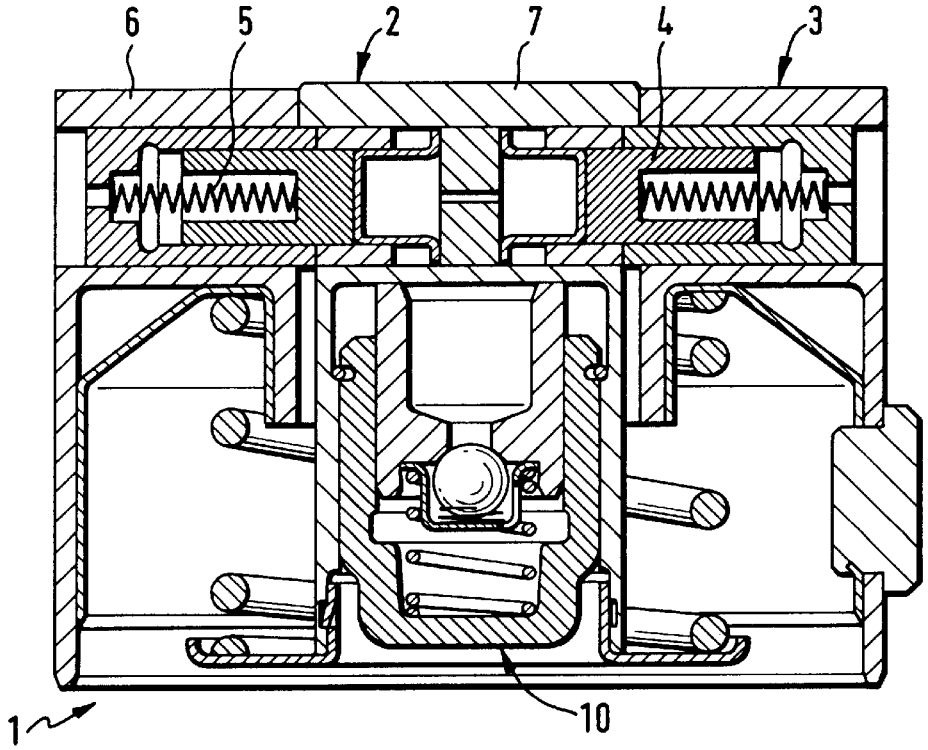
Figure 3:
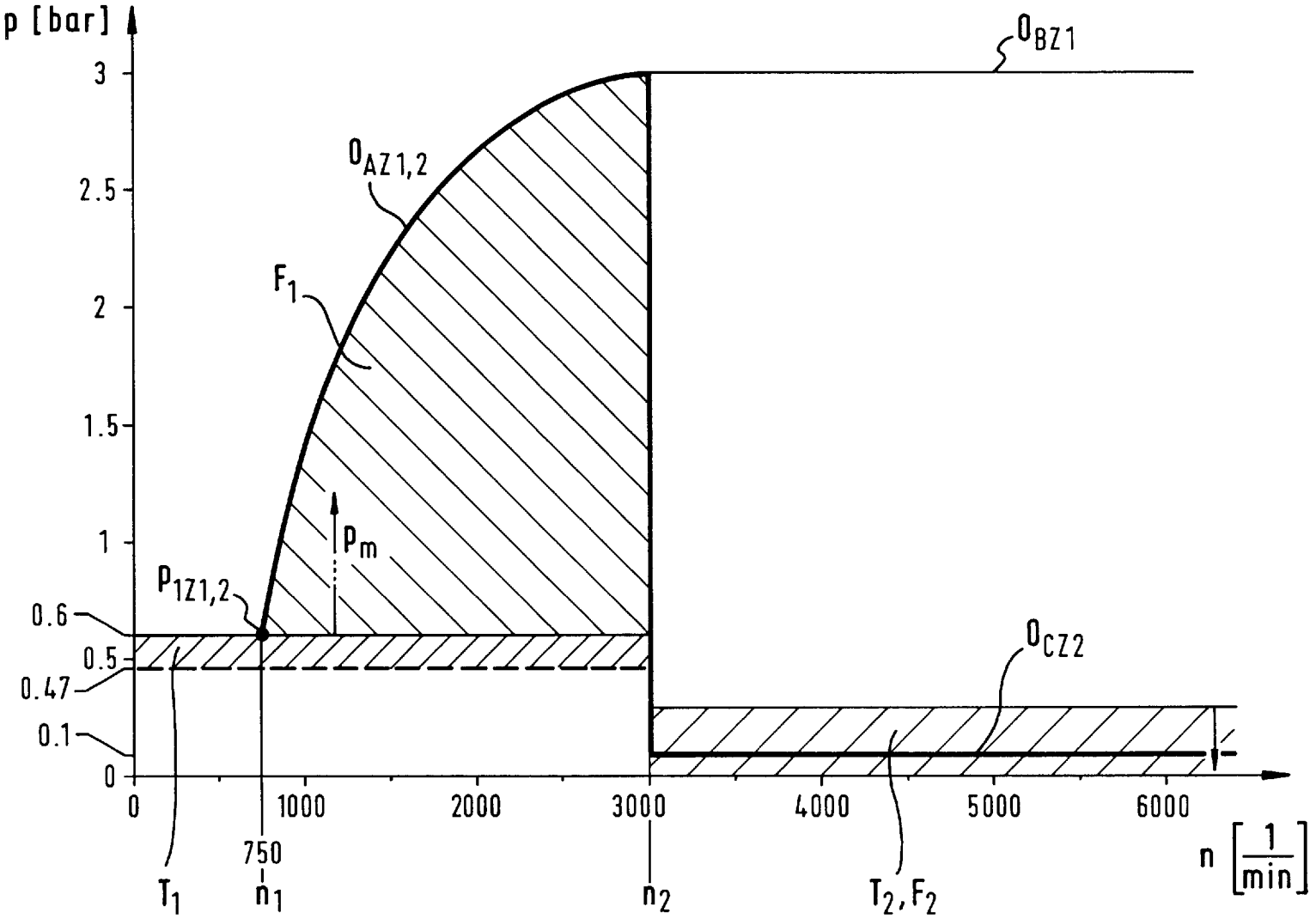

The invention is represented in the drawings which show,

FIGS. 1, 2, longitudinal cross-sections through a cam follower taken at 90° to each other, and FIG. 3, a diagram with the pressure in the channel in front of the coupling means and the clearance compensation device plotted against the engine speed.

FIG. 1 shows a cam follower 1 configured in the present case in the form of a cup tappet but, by analogy, it can also be considered as a support element. The cam follower 1 comprises an inner and an outer element 2, 3 inserted concentrically into each other. As can be seen more clearly in FIG. 2, radially displaceable coupling means 4 extend in the region of the bottoms of these elements 2, 3. In the present embodiment, the coupling means 4 are arranged in the outer element 3 and can be displaced radially from the outside to the inside in coupling direction by the force of at least one spring means 5 each. A circular ring-shaped bottom 6 of the outer element 3 is acted upon by at least one high lift cam, while a circular bottom 7 of the inner element 2 is loaded by a low lift or a zero lift cam. A coupling of the two elements 2, 3 by the coupling means 4 by spring force acting against hydraulic pressure causes a transmission of the lift of the high lift cam through the outer element 3 and the inner element 2 to at least one gas exchange valve, not shown. In the uncoupled state of the two elements 2, 3, the outer element 3 executes an idle stroke relative to the inner element 2. The gas exchange valve opens in accordance to the lift of the low lift cam.

Separate channels 9, 8 starting from the outer element 3 extend through the cam follower 1. These channels 9, 8 serve to transfer hydraulic medium respectively to the coupling means 4 and to a hydraulic clearance compensation device 10, which extends within the inner element 2 and faces the gas exchange valve.

The further structure of such a switchable cam follower 1 will not be described more closely here because it is sufficiently well-known in the art.

The force of the spring means 5 is designed so that an uncoupling against the spring force is effected at a hydraulic pressure of about 0.47 to 0.6 bars at the idling speed of the internal combustion engine (see FIG. 3). The graph $O_{AZ\ 1,2}$ characterizes the rise of hydraulic medium pressure in the channel in front of the coupling means 4 and the clearance compensation device 10. From a speed of about 3,000 rpm on, the hydraulic pressure in the channel 9 is reduced to about 0.1 bars ($O_{cz2}$). The coupling means 4 are thus displaced into a coupling position by the force of their spring means 5. As a result, the gas exchange valve opens completely from this speed range on. At the same time, the clearance compensation device 10 is optimally supplied with hydraulic medium pressure through the separate channel 8 as described above in the introductory description. If, during further operation of the internal combustion engine (provided the engine is running warm), the operating engine speed drops to below 3,000 rpm e.g., to 2,000 rpm, the control valve 11 once again releases unchoked hydraulic pressure into the channel 9. The coupling means 4 are thus displaced into their uncoupling position so that the gas exchange valve opens only in accordance to the low lift cam acting on the circular bottom 7.

Therefore, the coupling and uncoupling states of the coupling means 4 are established using only low switching pressures. The design of the spring means 5 in conjunction with the hydraulic pressure guarantees that the two elements 2, 3 are reliably uncoupled during warm running of the internal combustion engine at its idling speed $n_1$. At the same time, it is assured that the tolerance zones $T_1$ and $T_2$ (see introductory description) do not overlap each other so that no uncertain switching states arise.

Since a coupling of the two elements 2, 3 is required for starting the internal combustion engine, it is provided that during this state of operation of the internal combustion engine, or not only during this state but also till the internal combustion engine has reached its optimum operating temperature, the two elements 2, 3 remain coupled to each other. This is likewise achieved by a reduction of hydraulic pressure in the channel 9 to about 0.1 bars by the control valve 11, so that the coupling means 4 are displaced by their respective spring means 5 in coupling direction.

We claim:

1. A cam follower (1) of a valve drive of an internal combustion engine, having means for switching to at least two different lifts of at least one gas exchange valve, comprising an inner element (2) and an outer element (3) which are concentric relative to each other and can be coupled to each other at least indirectly by coupling means (4) which are displaceable radially so that, in a coupled state of said inner and outer element (2,3), a larger valve lift, and in an uncoupled state thereof, a smaller valve lift is realized, the coupling means (4) effecting coupling of said inner and outer element (2,3) under the force of a spring means (5) and uncoupling under hydraulic pressure, said cam follower (1) further comprising two separate channels (9, $Z_2$; 8, $Z_1$) starting from the outer element (3) and extending in the inner element (2) to supply hydraulic medium pressure to the coupling means (4) and to a hydraulic clearance compensation device (10), a control valve (11) being arranged in front of the channel (9, $Z_2$) to the coupling means (4), said control valve (11), during warm running of the internal combustion engine and during operation thereof in the partial and full load range, reduces the hydraulic pressure in the channel (9, $Z_2$) to a level which is lower than and distinct from the hydraulic pressure which serves to displace the coupling means (4) for uncoupling the elements (2, 3) so that a coupled state of the two elements (2, 3) prevails, characterized in that the force of the spring means (5) is designed so that an uncoupling is effected against the spring force by a hydraulic pressure which, at an operating temperature of the internal combustion engine is less than a minimum hydraulic pressure required for the clearance compensation device (10).

2. A cam follower of claim 1 wherein the force of the spring means (5) is designed so that the coupling means (4) uncouples at a hydraulic pressure of from 0.47 to 0.6 bars, and the control valve (11) in the switched state for coupling the elements (2, 3) reduces the hydraulic pressure in the channel (9, $Z_2$) leading to the coupling means (4) to a level between 0 and about 0.3 bars.

3. A cam follower of claim 2 wherein, in the switched state, the control valve (11) reduces the hydraulic pressure to about 0.1 bar.

4. A cam follower of claim 1 wherein a reduction of hydraulic pressure by the control valve (11) in the channel (9, $Z_2$) is effected from a speed of the internal combustion engine of about 3,000 rpm and above.

5. A cam follower of claim 1 wherein, during cold running of the internal combustion engine, and during cold running till warm running of the internal combustion engine has been reached, the control valve (11) is switched so that the hydraulic medium pressure in the channel (9, $Z_2$) is reduced to a level below and distinct from the hydraulic pressure for displacing the coupling means (4).

* * * * *